US007213911B2

(12) United States Patent
Taira

(10) Patent No.: US 7,213,911 B2
(45) Date of Patent: May 8, 2007

(54) INK-JET HEAD

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 318 days.

(21) Appl. No.: 10/879,178

(22) Filed: Jun. 30, 2004

(65) Prior Publication Data

US 2005/0030349 A1 Feb. 10, 2005

(30) Foreign Application Priority Data

Jun. 30, 2003 (JP) ..... 2003-187865

(51) Int. Cl.
*B41J 2/045* (2006.01)

(52) U.S. Cl. ..... 347/68; 57/71

(58) Field of Classification Search ..... 347/68–71, 347/57

See application file for complete search history.

(56) References Cited

U.S. PATENT DOCUMENTS 6,281,914 B1 8/2001 Hiwada et al.
6,386,672 B1 5/2002 Kimura et al.
2005/0104949 A1* 5/2005 Kamoshida et al. ..... 347/112
2006/0187250 A1* 8/2006 Takata ..... 347/10

FOREIGN PATENT DOCUMENTS

| | | |
|---|---|---|
| JP | A 05-330207 | 12/1993 |
| JP | B2 2803840 | 7/1998 |
| JP | A 10-217455 | 8/1998 |
| WO | WO 98/57809 | 12/1998 |

* cited by examiner

*Primary Examiner*—Lamson Nguyen
(74) *Attorney, Agent, or Firm*—Oliff & Berridge, PLC

(57) ABSTRACT

An ink-jet head comprises a passage unit, an actuator unit, an ink supply unit, a flexible substrate, and a driver IC. The actuator unit is fixed to one surface of the passage unit in order to change the volume of pressure chambers included in the passage unit. The ink supply unit is fixed to the passage unit and supplies ink to the passage unit. The flexible substrate is connected to the actuator unit and has a signal wire formed thereon for feeding electric power to the actuator unit. The driver IC is connected to the flexible substrate in order to drive the actuator unit, and held on the ink supply unit.

15 Claims, 7 Drawing Sheets

INK-JET HEAD

BACKGROUND OF THE INVENTION

1. Field of the Invention

The present invention relates to an ink-jet head that conducts recordings by ejecting ink onto a recording medium.

2. Description of Related Art

An ink-jet head ejects ink by means of, applying pressure to ink using a piezoelectric element, applying thermal energy to ink using a heater, and the like.

According to one of techniques that adopt the latter method, an ink passage formed on a substrate has therein a heating element which generates heat upon driving of a driver IC, and thermal energy thus generated is applied to ink contained in the ink passage (see Japanese Patent No. 2803840). A heat sink having a plurality of fins is provided opposite to the ink passage across the substrate. Since the heat sink dissipates heat, members of the head such as the driver IC, and ink contained in the ink passage are prevented from excessively rising in temperature. As a result, a stable ink ejection can be obtained.

In the above-described technique, however, an ink-jet head disadvantageously incurs a size increase of itself, because the fins constituting the heat sink protrude substantially throughout one face of the substrate.

SUMMARY OF THE INVENTION

An object of the present invention is to provide an ink-jet head capable of dissipating heat of a driver IC and at the same time reducing a size of itself.

According to an aspect of the present invention, there is provided an ink-jet head comprising a passage unit, an actuator unit, an ink supply unit, a flexible substrate, and a driver IC. The passage unit includes a plurality of nozzles that eject ink, and a plurality of pressure chambers connected to the respective nozzles. The actuator unit is fixed to one surface of the passage unit in order to change the volume of the pressure chambers. The ink supply unit is fixed to the passage unit and supplies ink to the passage unit. The flexible substrate is connected to the actuator unit and has a signal wire formed thereon for feeding electric power to the actuator unit. The driver IC is connected to the flexible substrate in order to drive the actuator unit. The driver IC is held on the ink supply unit.

According to the above-described structure, heat of the driver IC can be dissipated, because the ink supply unit having a relatively large heat capacity is disposed in contact with the driver IC. Since, like this, the ink supply unit is employed for dissipating heat of the driver IC, a heat sink, etc., is not specially required and therefore the head can be downsized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a preferred embodiment of the present invention will be described with reference to the accompanying drawings.

Figure 1:
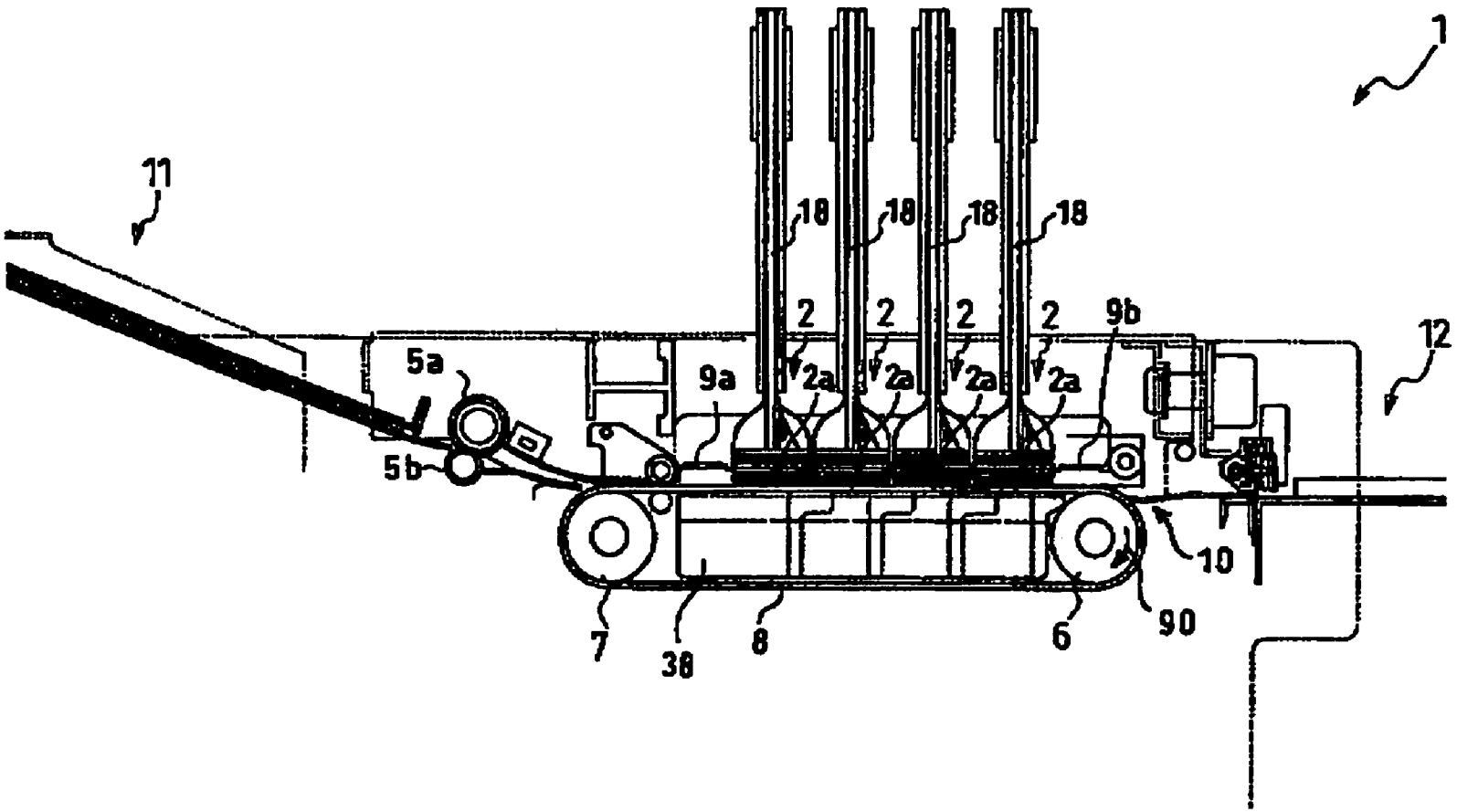
FIG. 1 illustrates a general structure of an exemplified ink-jet printer that includes ink-jet heads according to an embodiment of the present invention.

FIG. 1 illustrates an exemplified ink-jet printer that includes ink-jet heads according to an embodiment of the present invention. An ink-jet printer 1 illustrated in FIG. 1 is a color ink-jet printer comprising four ink-jet heads 2. The ink-jet printer 1 comprises a paper feed unit 11 (on a lefthand in FIG. 1) and a paper discharge unit 12 (on a righthand in FIG. 1). Within the printer 1, formed is a paper conveyance path extending from the paper feed unit 11 to the paper discharge unit 12.

A pair of paper feed rollers 5*a* and 5*b* are disposed immediately downstream of the paper feed unit 11 so that a paper as a medium is conveyed from left to right in FIG. 1. Two belt rollers 6 and 7, a looped conveyor belt 8, and a substantially rectangular parallelepiped belt guide 38 are disposed in a middle of the paper conveyance path. The conveyor belt 8 is wrapped around the belt rollers 6 and 7 to be stretched between them. The belt guide 38 is disposed within a region enclosed by the conveyor belt 8. The belt guide 38 and the conveyor belt 8 have substantially the same width. The belt guide 38 is in contact with an inner surface of the conveyor belt 8 at an upper part thereof, and thereby supports the conveyor belt 8.

An outer surface of the conveyor belt 8 is formed of a silicone rubber. A paper fed through the pair of paper feed rollers 5*a* and 5*b* is held onto the conveyor belt 8 by adhesive power, and in this condition conveyed downstream, i.e., rightward in FIG. 1 as one belt roller 6 is driven in clockwise rotation in FIG. 1 (i.e., rotation in a direction of an arrow 90).

Pressing members 9*a* and 9*b* are provided at positions for feeding a paper onto the conveyor belt 8 and discharging a paper from the conveyor belt 8, respectively. The pressing members 9*a* and 9*b* serve to press a paper onto the conveyor belt 8 in order to prevent a separation of a paper from the conveyor belt 8. The paper is surely held onto the conveyor belt 8 by the adhesive power.

A peeling plate 10 is provided immediately downstream (i.e., on a right side in FIG. 1) of the conveyor belt 8. The peeling plate 10 peels off a paper, which is held onto the conveyor belt 8, from the conveyor belt 8 so that the paper can be transferred to the righthand paper discharge unit 12.

Each of the four ink-jet heads 2 has, at its lower end, a head main body 2*a*. Each head main body 2*a* has a rectangular section. The head main bodies 2*a* are arranged adjacent to one another with a longitudinal axis of each head main body 2*a* being perpendicular to a paper conveyance direction, i.e., perpendicular to the drawing sheet of FIG. 1. That is, this printer 1 is a line type printer. A bottom face of each head main body 2*a* confronts the paper conveyance path. In the bottom faces of the respective head main bodies 2*a*, formed are a large number of small-diameter nozzles (see FIG. 2). The four head main bodies 2*a* eject from their nozzles 13 ink of magenta, yellow, cyan, and black, respectively.

The ink-jet heads 2 are, by means of holders 18, mounted on a suitable member provided in the printer 1. The holders 18 are fixed, with an adhesive or screws, etc., to a later-described ink supply unit 40 that occupies an upper portion of the head main bodies 2*a*.

The ink-jet heads 2 are disposed such that a narrow clearance may be formed between lower faces of the head main bodies 2*a* and a conveyance face of the conveyor belt 8. The paper conveyance path is formed within this clearance. With this construction, while a paper, which is being conveyed by the conveyor belt 8, passes immediately below the four head main bodies 2*a* in order, the respective color inks are ejected through the corresponding nozzles 13 (see FIG. 2) toward an upper face, i.e., a print face, of the paper to thereby form a desired color image on the paper.

Figure 4:
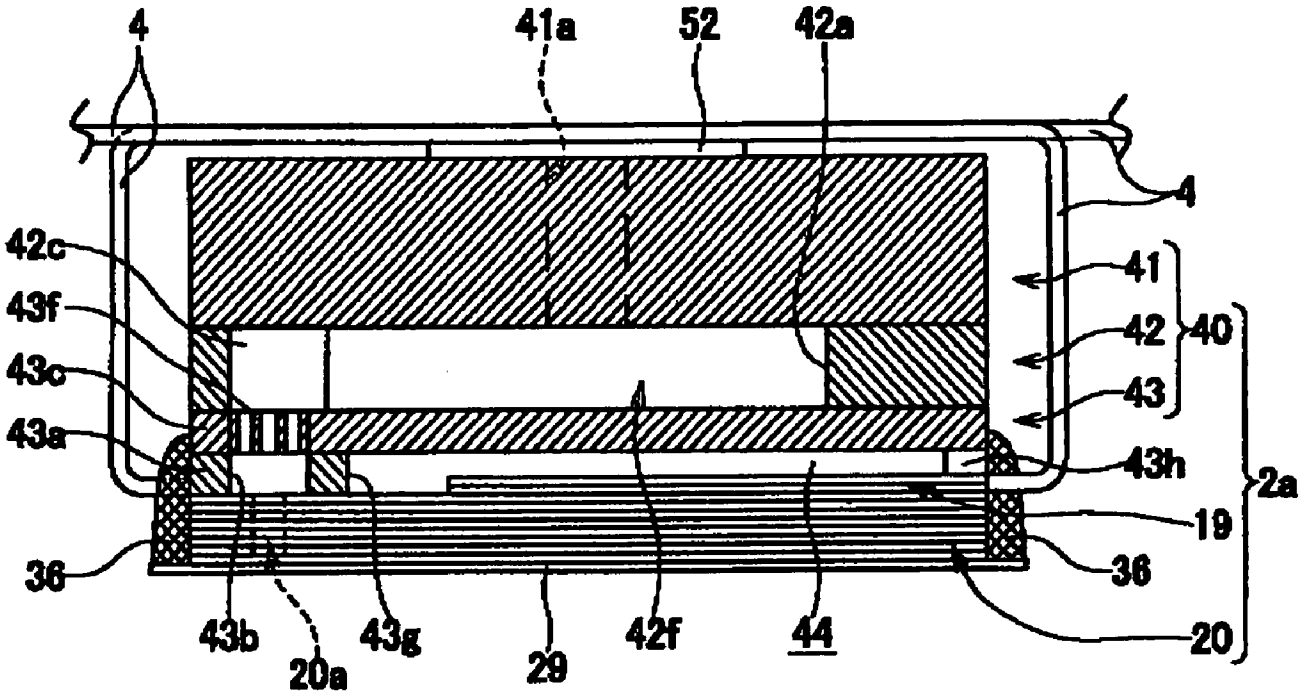
FIG. 4 is a sectional view taken along a line IV—IV of FIG. 3.

Next, a description will be given to a construction of the head main body 2*a* of the ink-jet head 2. As illustrated in FIG. 4, the head main body 2*a* includes an ink supply unit 40, a passage unit 20, and actuator units 19.

Figure 2:
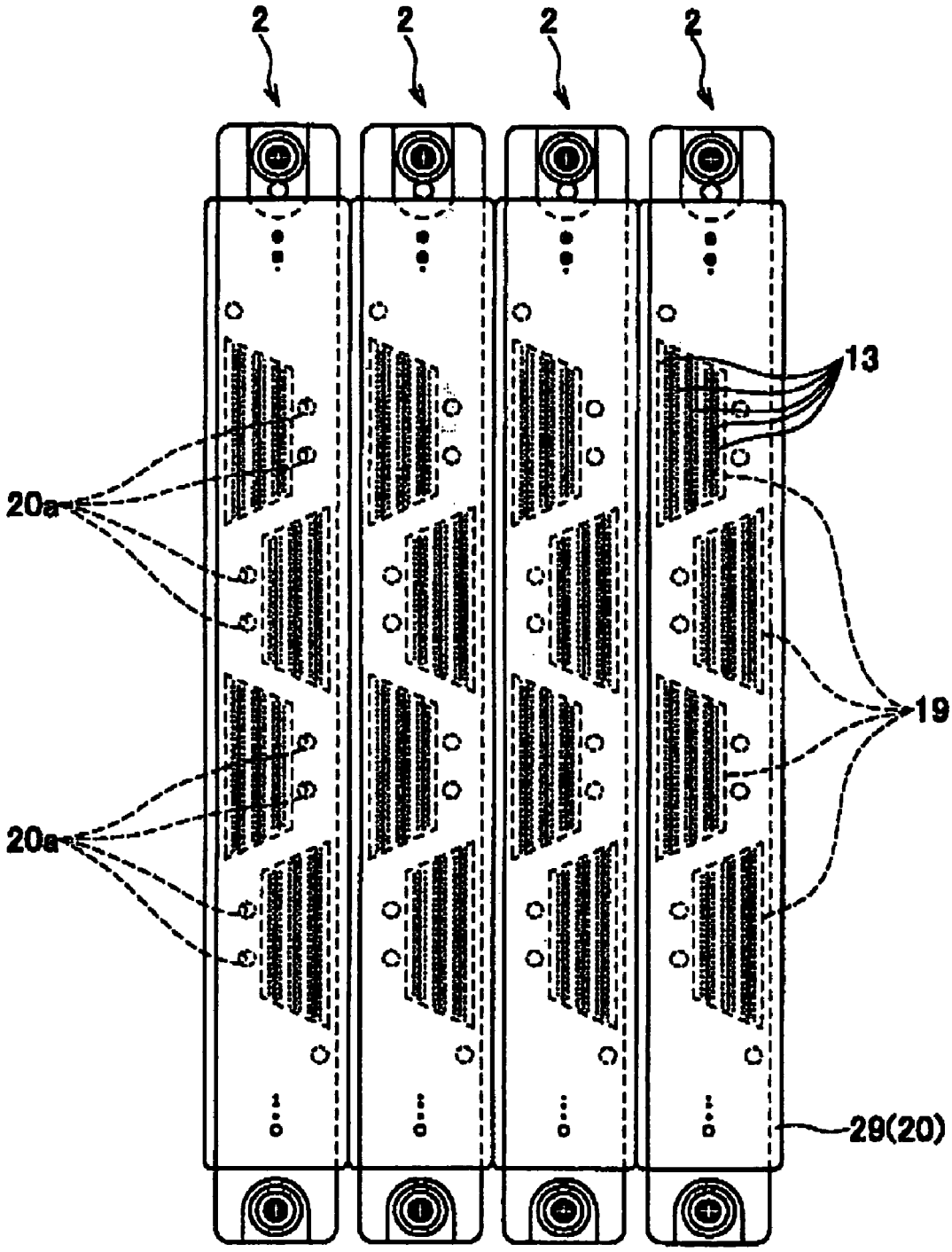
FIG. 2 is a bottom view of the ink-jet heads of FIG. 1 that are arranged in parallel.
Figure 3:
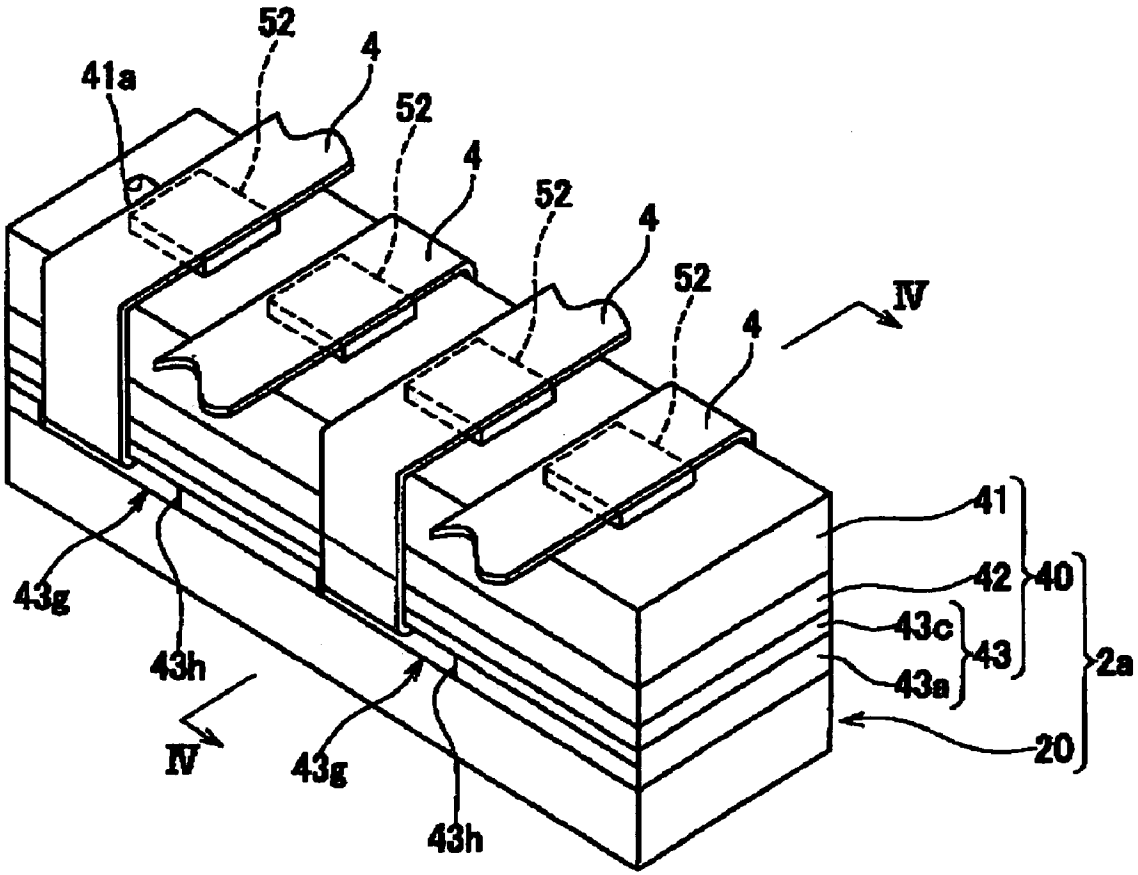
FIG. 3 is a perspective view of a head main body of the ink-jet head of FIG. 1.
Figure 5:
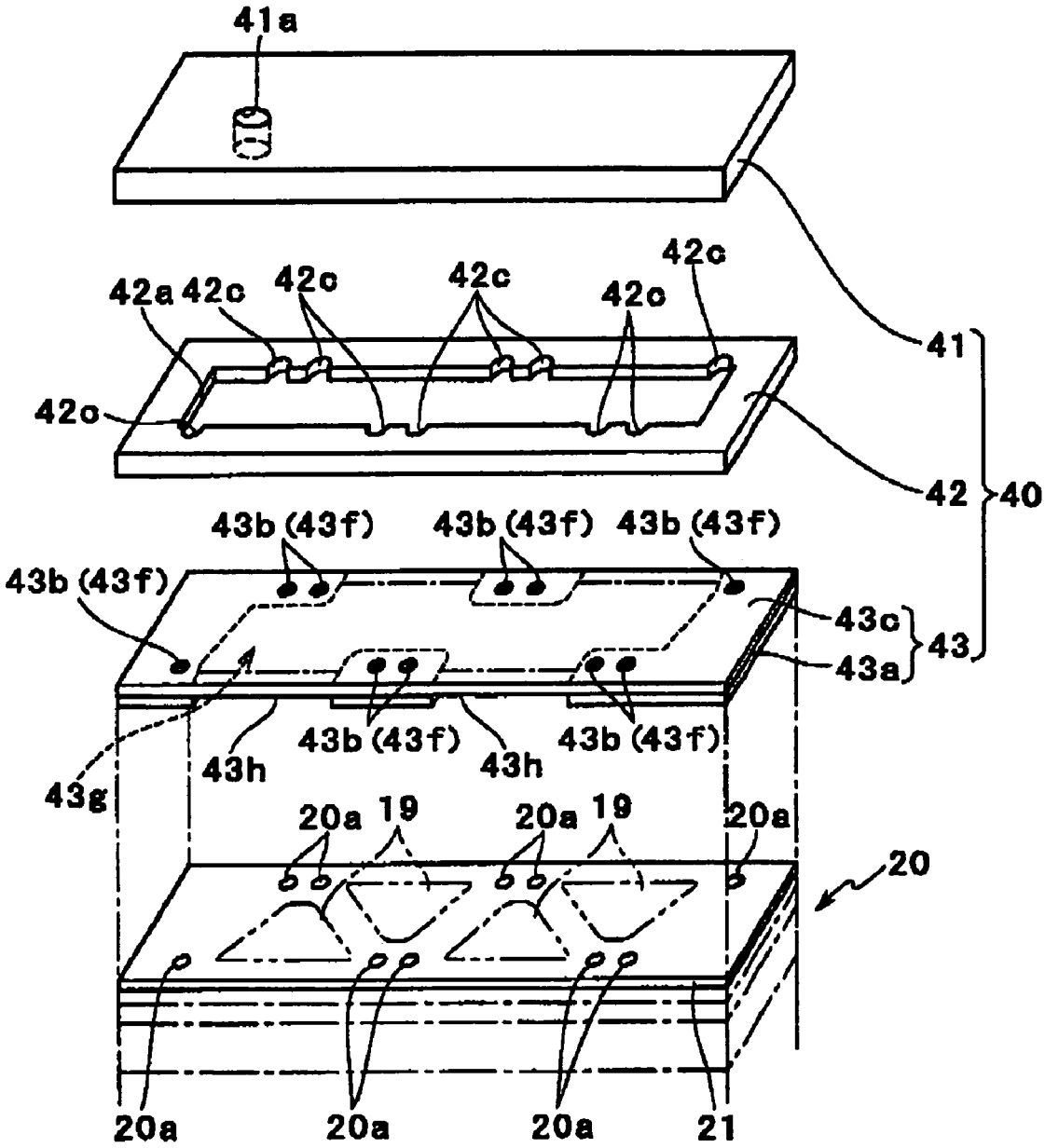
FIG. 5 is an exploded perspective view of an ink supply unit illustrated in FIGS. 3 and 4.
Figure 6:
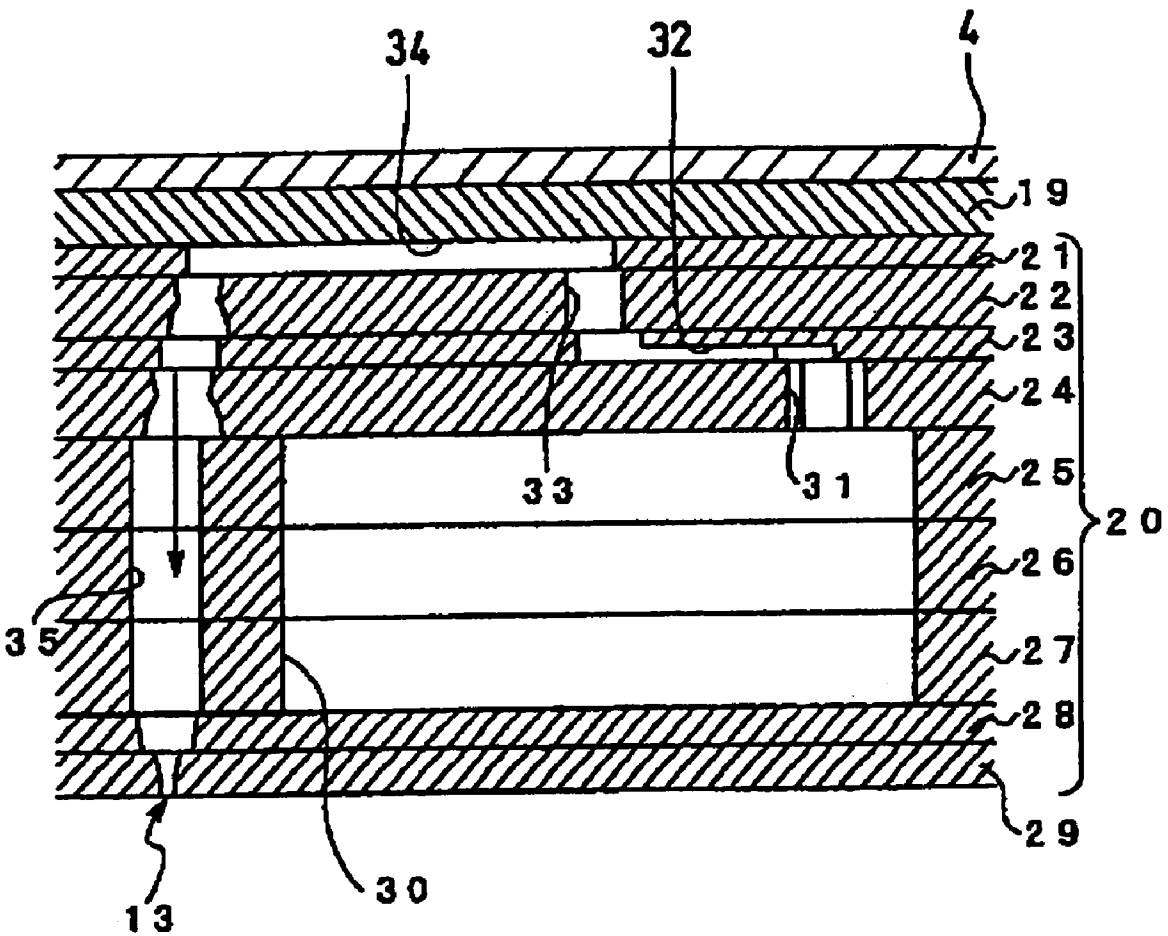
FIG. 6 is a local sectional view of a passage unit illustrated in FIGS. 3 and 4.

The ink supply unit 40 supplies ink into the passage unit 20, and has a layered structure of three substantially rectangular plates 41, 42, and 43 (a first plate 41, a second plate 42, and a third plate 43 from the top), as illustrated in FIGS. 3 and 4. The passage unit 20 has, as illustrated in FIG. 6, a layered structure of nine thin metal plates 21, 22, 23, 24, 25, 26, 27, 28, and 29. The passage unit 20 includes the above-mentioned large number of nozzles 13 and a plurality of pressure chambers 34 connected to the respective nozzles 13. The actuator unit 19 is a thin sheet-like member for changing the volume of the pressure chambers 34. As illustrated in FIGS. 2 and 5, the actuator unit 19 has a substantially trapezoidal shape in a plan view.

It can be seen from FIGS. 2 and 5 that a plurality of actuator units 19 are arranged on and bonded to an upper face of the passage unit 20 in a zigzag pattern along a lengthwise direction of the passage unit 20. Each actuator unit 19 is disposed with its parallel opposed sides, i.e., upper and lower sides, extending along the lengthwise direction of the passage unit 20. Oblique sides of the neighboring actuator units 19 overlap each other in a widthwise direction of the passage unit 20. In a lower face of the passage unit 20, an area corresponding to a region where each actuator unit 19 is bonded is formed as an ink ejection region.

In regions of the upper face of the passage unit 20 where no actuator unit 21 is bonded, formed are a plurality of circular inlet ports 20*a* (see FIGS. 2, 4, and 5). As illustrated in FIGS. 2 and 5, the inlet ports 20*a* include ones disposed at diagonal positions near both lengthwise ends of the passage unit 20, and ones disposed in pairs in a zigzag pattern along shorter sides of the parallel opposed sides of the respective actuator unit 19.

As illustrated in FIG. 4, the ink supply unit 40 is bonded to such regions of the upper face of the passage unit 20 as to include and surround the inlet ports 20*a*. In the remaining region thereof including the region where the actuator units 19 are bonded, the ink supply unit 40 is spaced from the passage unit 20. On the upper face of the passage unit 20, the actuator units 19 are disposed out of the regions where the ink supply unit 40 is bonded. Thus, the actuator units 19 are in no contact with the ink supply unit 40 and at a predetermined distance therefrom.

Subsequently, there will be described constructions of the aforementioned three elements that constitute the head main body 2*a*.

First, the ink supply unit 40 will be described.

Among the three plates forming the ink supply unit 40, the first and second plates 41 and 42 are made of a metal such as stainless steels, and the third plate 43 is formed as a layered structure of a metal plate 43*a* such as stainless steels and a resin plate 43*c* such as polyimide. The third plate 43 is so disposed that the metal plate 43*a* may confront the passage unit 20. FIGS. 3, 4, and 5 show that the first plate 41 has a larger thickness than those of the other two plates 42 and 43.

As illustrated in FIG. 5, at a widthwise center near one lengthwise end of the first plate 41, formed by etching, etc., is an ink introduction port 41*a* penetrating through the plate 41 in its thickness direction. Ink is introduced into the ink introduction port 41*a* from an ink supply source (not illustrated) via a tube, etc.

In the second plate 42, a hole to constitute an ink reservoir 42*a* for storing ink is formed by press working, etc. The hole to constitute the ink reservoir 42*a* extends along a lengthwise direction of the second plate 42. Further, a plurality of notches 42*c* each having a substantially semicylindrical shape are serially formed at sidewalls of the hole that constitutes the ink reservoir 42*a*.

Ink outlet ports 43*b* are formed at such portions of the metal plate 43*a* of the third plate 43 as to correspond to inlet ports 20*a* formed in the passage unit 20. Each of the ink outlet ports 43*b* has the same shape as that of the inlet port 20*a*, and penetrates through the metal plate 43*a* in its thickness direction. These portions where the ink outlet ports 43*b* are formed correspond also to the notches 42*c* formed in the second plate 42.

Ink filters 43*f* are formed at such portions of the resin plate 43*c* of the third plate 43 as to correspond to the inlet ports 20*a* formed in the passage unit 20, i.e., as to correspond to the aforementioned ink outlet ports 43*b*. Each of the ink filters 43*f* has the same outline as those of the inlet port 20*a* and the ink outlet port 43*b*.

The ink outlet ports 43*b* can be formed by etching the metal plate 43*a*. Then, the filters 43*f* can easily be formed by performing excimer laser machining on the resin plate 43*c* so that a large number of small-diameter pores (16 to 24 micrometers) are formed to neighbor one another in a concentrated manner at the portions of the resin plate 43*c* corresponding to the ink outlet ports 43*b*. Adopting the above-described method for forming a filter, there can be obtained the filter 43*f* in which pores are stabilized in shape and size, and at the same time a manufacture cost of the filter 43*f* can be reduced.

Further, a part of the metal plate 43*a* of the third plate 43 has been cut off by etching, etc., and remaining are only areas including the ink outlet ports 43*b*, which are indicated by dotted lines in FIG. 5. Thus, a concavity 43*g* appears in the third plate 43 on a side facing the passage unit 20. The concavity 43*g* serves as a space 44 (see FIG. 4) in which the actuator units 19, illustrated in FIG. 5 on the surface of the passage unit 20 with alternate long and two short dashes lines, are to be arranged.

Protrusions 43*h* protruding toward a passage unit 20 side are formed at areas of the metal plate 43*a* corresponding to outsides of long sides of the actuator units 19, i.e., at areas outside alternate long and short dash lines in FIG. 5 (see FIG. 4). Each of the protrusion 43*h* has such a height that a later-detailed flexible printed circuit (FPC) 4 may extend out of the space 44. These protrusions 43*h* close the space 44.

The number of processing steps can be reduced by simultaneously performing two etchings on the metal plate 43*a*, i.e., the etching for forming the concavity 43*g* and the etching for forming the ink outlet ports 43*b*.

The above-described first plate 41, the second plate 42, and the third plate 43 are put in layers, so that the ink supply unit 40 is formed therein with an ink branching passage that branches ink from the ink introduction port 41*a* into the ink outlet ports 43*b*.

The ink reservoir 42*a* temporarily reserves therein ink, which then flows through the notches 42*c* into the filters 43*f*, and then reaches the ink outlet ports 43*b*. In this embodiment, ink does not incur so much change in passage resistance before and after the ink passes through the filters 43*f*, i.e., while the ink flows out of the notches 42*c* into the ink outlet ports 43*b*. This allows the ink to flow smoothly, without the bubbles being generated when the ink passes the filters 43*f*.

The ink supply unit 40 is bonded to the passage unit 20 such that the notches 42*c* and the corresponding inlet ports 20*a* may communicate with each other. Thus, ink reserved within the ink reservoir 42*a* of the ink supply unit 40 can be introduced through the inlet ports 20*a* into the passage unit 20. The plurality of inlet ports 20*a* are arranged at a distance from one another along the lengthwise direction of the passage unit 20. Therefore, even when the head 2 is elongated, ink reserved in the ink reservoir 42*a* can stably be supplied to the passage unit 20 with its passage resistance restrained.

Next, a construction of the passage unit 20 will be described in detail.

As illustrated in FIG. 6, the nine metal plates constituting the passage unit 20 are hereinbelow referred to as, from the top, a first plate 21, a second plate 22, a third plate 23, a fourth plate 24, a fifth plate 25, a sixth plate 26, a seventh plate 27, a eighth plate 28, and a ninth plate 29. Each of the plates 21 to 29 has holes or openings formed therein by etchings including half-etchings, laser machinings, or press workings, etc.

A manifold channel 30 is formed in the fifth to seventh plates 25 to 27 in such a manner as to extend over these three plates. The manifold channel 30 communicates with the above-described inlet ports 20*a* (see FIGS. 2, 4, and 5) via a non-illustrated path. The forth plate 24 has connection holes 31 formed therein, and the connection holes 31 communicate with corresponding apertures 32 that are formed in the third plate 23.

Each of the apertures 32 functions as a throttle for adjusting a passage resistance, and communicates, via each of communication holes 33 formed in the second plate 22, with one end of each pressure chamber 34 formed in the first plate 21. The pressure chambers 34, which are formed in one-to-one correspondence with the respective nozzles 13, serve to apply pressure to ink upon driving of the actuator units 19 fixed onto the upper face of the passage unit 20. The other end of each pressure chamber 34 communicates, via each of nozzle connection holes 35 formed throughout the second to eighth plates 22 to 28, with a corresponding tapered nozzle 13 formed in the ninth plate 29.

The manifold channel 30 communicates with the pressure chambers 34 through the apertures 32. The manifold channel 30 temporarily reserves therein ink that has been introduced from the inlet ports 20*a*, and distributes the ink among the respective pressure chambers 34.

In the head main body 2*a*, ink supplied from the ink supply source (not illustrated) is firstly introduced through the ink introduction port 41*a* into the ink reservoir 42*a*, where the ink is reserved for a time (see FIGS. 4 and 5). The ink reserved in the ink reservoir 42*a* subsequently passes through the notches 42*c*, and then through the filters 43*f*. At this time, foreign matters mixed in the ink are removed by the filters 43*f*. The ink, after passing through the filters 43*f*, reaches the ink outlet ports 43*b*. The ink is then led from the ink outlet ports 43*b* into the inlet ports 20*a* of the passage unit 20, and further into the manifold channel 30. The ink in the manifold channel 30 is supplied to the respective pressure chambers 34 through the connection holes 31, the apertures 32, and the communication holes 33 (see FIG. 6). Then, upon driving of the actuator unit 19, pressure is applied to the ink in the respective pressure chambers 34 so that the ink is ejected from the corresponding nozzles 13 through the nozzle connection holes 35.

A construction of the actuator unit 19 will then be described in detail.

The actuator unit 19 is formed of a layered structure of a plurality of piezoelectric sheets made of, e.g., a lead zirconate titanate (PZT)-base ceramic material. Thin film electrodes made of., e.g., an Ag—Pd-base metallic material are interposed between the piezoelectric sheets, so that active portions are formed at regions facing respective pressure chambers 34. When the electrodes disposed between the piezoelectric sheets cause a potential difference from one another, the respective active portions deform into a convex shape toward the pressure chamber 34 side. As a result, the corresponding pressure chambers 34 are reduced in volume, so that pressure is applied to the ink contained in the pressure chambers 34.

An FPC 4 is bonded onto an upper face of each actuator unit 19 (see FIG. 6). Signal wires for feeding electric power to the actuator unit 19 are formed on the FPC 4. As illustrated in FIG. 4, the FPCs 4 are bent on sides of the head main body 2*a* to extend upward therefrom. Silicon-base sealing members 36 are disposed at side portions of the head main body 2*a* corresponding to openings through which the FPCs 4 extend outward. The sealing members 36 safeguard the FPCs 4 as well as seal the space 44 in order to prevent ink, etc., from entering the space 44.

As illustrated in FIG. 3, the head main body 2*a* has four driver ICs 52 aligned thereon along its lengthwise direction. Each FPC 4 extending out of the inside of the head main body 2*a* is connected to an upper face of the corresponding driver IC 52, and thus the driver IC 52 is held between the ink supply unit 40 and the FPC 4. The FPC 4 is connected to the driver IC 52, and moreover connected to a substrate (not illustrated) that is fixed to the holder 18 (see FIG. 1) and has an MCU (Micro Controller Unit), etc., mounted thereon.

The driver IC 52 generates drive pulses for driving the actuator unit 19, and the drive pulses are supplied via the FPC 4 to the actuator unit 19, thereby causing deformations of the aforementioned active portions. This potential control is performed on the respective pressure chambers 34 independently of one another.

As described above, the ink-jet head 2 of this embodiment can dissipate heat of the driver ICs 52, because the ink supply unit 40 having a relatively large heat capacity is disposed in contact with the driver ICs 52. Since, like this, the ink supply unit 40 is employed for dissipating heat of the driver ICs 52, a heat sink, etc., is not specially required and therefore the head 2 can be downsized.

In addition, as illustrated in FIG. 3, the driver ICs are held between the ink supply unit 40 and the corresponding FPCs 4. Accordingly, on the ink supply unit 40, the driver ICs can be held in a stable manner, and at the same time the FPCs 4 can be connected to the driver ICs 52 in a stable manner.

Moreover, since the first plate 41, which is closest to the driver ICs 52 among the plate forming the ink supply unit 40, is made of a metal, heat of the driver ICs 52 can be dissipated efficiently.

The ink supply unit 40 has the layered structure of the three plates 41, 42, and 43, among which the first plate 41 closest to the driver ICs 52 has a larger thickness than those of the other plates. The first plate 41 having such a larger thickness and therefore having a relatively large heat capacity enables more efficient dissipation of the heat of the driver ICs 52.

The passage unit 20 is fixed to the ink supply unit 40 on a side opposite to the driver IC 52, and the resin plate 43*c* of the ink supply unit 40 is disposed near the passage unit 20. The resin plate 43*c* disposed in this manner can prevent a further heat transfer to the passage unit 20, which otherwise follows a heat transfer from the driver ICs 52 to the ink supply unit 40. This can relieve the problem of a temperature rise of the passage unit 20 and therefore a temperature rise of ink contained in the passage unit 20.

The driver ICs 52 are in contact with a plate of the ink supply unit 40 other than the resin plate 43*c*, i.e., in contact with the first plate 41 made of a metal. Such an ink supply unit 40 of this embodiment has a larger heat capacity and thus heat of the driver ICs can be dissipated more efficiently, as compared with another structure in which the resin plate 43*c* is contactable with the driver ICs 52. More specifically, the heat generated by the driver ICs 52 is transferred firstly to the first sheet 41 made of a metal and then to the second sheet 42 made of a metal, too. Through this process the heat is dissipated.

Further, since the ink supply unit 40 includes therein the ink filters 43*f*, foreign matters such as dust and dirt contained in ink can be removed within the ink supply unit 40 in advance prior to introduction into the passage unit 20. Consequently, there is less need to provide filters inside ink passages (see FIG. 6) of the passage unit 20. When no filter is provided in the passage unit 20 as in this embodiment, the plates 21 to 29 constituting the passage unit 20 can be aligned with one another with relative ease. Therefore, the ink-jet head 2 can readily be manufactured, so as to realize an improved manufacture yield and reduced manufacture cost.

Still further, the ink supply unit 40 includes the resin plate 43*c* having the filters 43*c* formed therein, and the metal plate 43*a* bonded to one face of the resin plate 43*c*. Such a double-layered structure of the metal plate and the resin plate can not only facilitate a formation of the filters 43*f* but also keep good strength of the resin plate 43*c*. In addition, the third plate 43 made up of the resin plate 43*c* and the metal plate 43*a* can be laminated with the second plate 42 with more ease.

Here, a further modification of the ink-jet head according to the present invention will be described with reference to FIG. 7.

Figure 7:
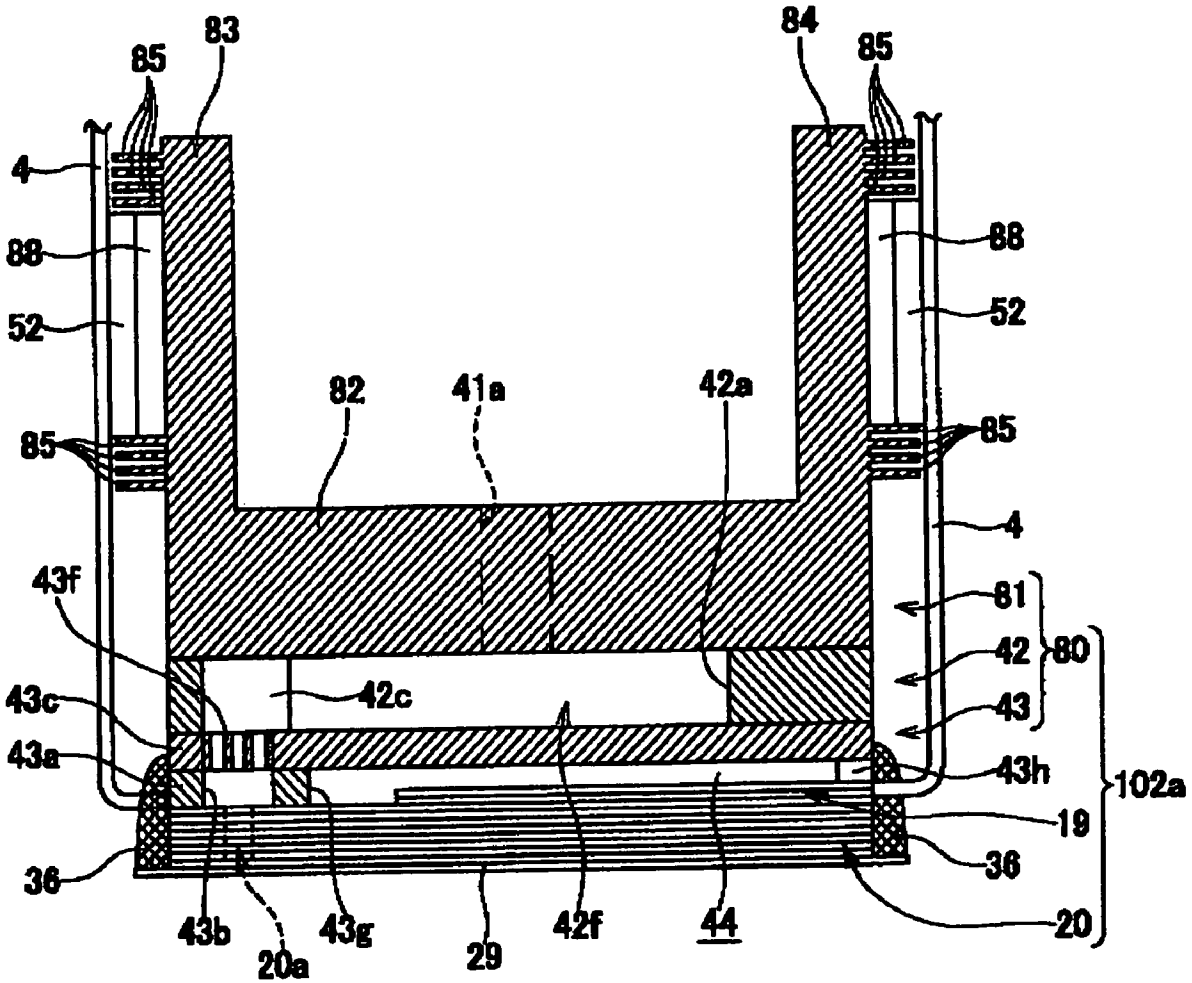
FIG. 7 is a sectional view, which corresponds to FIG. 4, of an exemplified modification of the ink-jet head of the present invention.

FIG. 7, which corresponds to FIG. 4, shows a sectioned head main body 102*a* of an ink-jet head according to this modification. The head main body 102*a* of this modification differs from the above-described embodiment mainly in a construction of the ink supply unit and in a position of the driver IC. The other members of the head such as the passage unit 20, etc., are the same as those of the aforementioned embodiment, and therefore they will be denoted by the common reference numerals and descriptions thereof are omitted.

An ink supply unit 80 includes a first plate 81, a second plate 42, and a third plate 43. The first plate 81 has a different configuration from that of the aforementioned embodiment. The second and third plates 42 and 43 are the same as those of the aforementioned embodiment.

The first plate 81 comprises a base 82 and two plate-like protrusions 83 and 84. The base 82 has substantially the same shape as that of the first plate 41 in the aforementioned embodiment, and an ink introduction port 41*a* is formed in the base 82. Each of the two plate-like protrusions 83 and 84 protrudes vertically upward from an upper face of the base 82: at each widthwise end of the base 82. Thus, the ink supply unit 80 has a U-shaped section.

Eight ribs 85 are formed on an outer surface of each of the protrusions 83 and 84. The eight ribs 85 protrude perpendicularly to the outer surface, i.e., in a horizontal direction. One set of four ribs 85 is provided at a predetermined distance from the other set of four ribs 85 in a vertical direction. Between these two sets of four ribs 65, disposed are a driver IC 52 and a thermal conductive member 88 such as a sponge. The thermal conductive member 88 is connected to the outer surface of each protrusion 83, 84, and the driver IC 52 is connected to an outer surface of the thermal conductive member 88. An FPC 4, which is bent at a side of the head main body 2*a* and extends upward therefrom, is connected to an outer surface of the driver IC 52.

Like this, the ink-jet head of this embodiment can more efficiently dissipate heat of the driver ICs 52, because the thermal conductive members 88 are interposed between the driver ICs 52 and the ink supply unit 80. More specifically, heat of the driver ICs 52 is transferred firstly to the thermal conductive members 88 and then to the protrusions 83 and 84 of the ink supply unit 80. Through this process the heat is dissipated.

In addition, the ink supply unit 80 has the protrusions 83 and 84, on which the driver ICs 52 are held. By providing the protrusions 83 and 84 in this manner, the ink supply unit 80 obtains an increased surface area and thus a larger heat capacity. Therefore, heat of the driver ICs 52 can efficiently be dissipated still more. Moreover, the heat of the driver ICs 52 is, prior to being transferred to the base 82, dissipated in the protrusions 83 and 84 to some extent. Accordingly, a relatively less quantity of heat is transferred to the base 82, and the second and third plates 42 and 43 located below. This can still better relieve the problem of a temperature rise of the passage unit 20 located further below, and therefore a temperature rise of ink contained in the passage unit 20.

In this modification, particularly, the two protrusions 83 and 84 protrude vertically upward from the widthwise ends of the ink supply unit 80, so that the ink supply unit 80 has the U-shaped section. The ink supply unit 80 having such a U-shaped configuration can provide the same effects as mentioned above, i.e., improved dissipation of the heat of the driver ICs 52 and prevention of temperature rise of the passage unit 20.

The driver ICs 52 are held between the protrusions 83, 84 and the FPCs 4. As a result, on the ink supply unit 80, the driver ICs 52 can be held in a stable manner, and at the same time the FPCs 4 can be connected to the driver ICs 52 in a stable manner, as stated in the aforementioned embodiment, too.

The formation of the ribs 85 on the protrusions 83 and 84 further increases the surface area of the ink supply unit 80. Due to this increased surface area, dissipation of heat of the drive ICs 52 improves still more.

The number of the protrusions is not limited to two, but one protrusion, and three or more protrusions can be employed. The formation of the protrusions need not always result in the ink supply unit having the U-shaped section. In addition, the protrusions can do without the ribs 85.

The thermal conductive member 88 can be omitted from the above modification.

In the aforementioned embodiment and modification, a material for the resin sheet 43*c* is not limited to polyimides, and, e.g., polyester, vinyl chloride and the like are also adoptable. Moreover, a material for the metal sheet 43*a* is not limited to stainless steels, and nickel alloys such as 42 alloy or invar are also adoptable. A material for the first plate 41 or 81 and the second plate 42 is not limited to stainless steels, either, and nickel alloys such as 42 alloy or invar are also adoptable.

It is not always required that the third plate 43 has the double-layered structure of the resin plate 43*c* and the metal plate 43*a*. The ink filters 43*f* can be omitted from the ink supply unit 40 or 80. Further, the resin member such as the resin plate 43*c* can also be omitted from the ink supply unit 40 or 80.

In the aforementioned embodiments the first plate 41 is not necessarily thicker than the other plates 42 and 43. The three plates 41 to 43 may have the same thickness, for example.

Although the ink supply unit 40 in the aforementioned embodiment has the layered structure of three plates, a layered structure of two plates or four or more plates may also be acceptable. The ink supply unit is not limited to a layered structure of a plurality of plates, and may be configured as a single member.

It is not always necessary that a part of the supply unit 40 or 81 closest to the driver IC 52 is made of a metal.

The driver IC 52 may not be held between the ink supply unit 40 or 80 and the FPC 4, as long as the driver IC 52 is held on the ink supply unit 40 or 80.

The ink passage formed within the ink supply unit and the passage unit may variously be changed. For example, it is possible to form two or more ink introduction ports 41*a*, or to shape the ink introduction port 41*a* into square or ellipse. Regions where the filters 43*f* are formed may be changed in accordance with a shape of the ink introduction port 43*b*.

The number of heads to be included in the printer is not limited to four, and the printer is not limited to a color printer.

The present invention is applicable not only to a line-type ink-jet printer that performs printing while conveying a paper relative to the fixed head main body 2*a* as in the aforementioned embodiment, but also to a serial-type ink-jet printer that performs printing while, for example, conveying a paper and at the same time reciprocating the head main body 2*a* perpendicularly to a paper conveyance direction.

The application of the present invention is not limited to a printer. The present invention is also applicable, for example, to ink-jet type facsimile machines or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit including a plurality of nozzles that eject ink, and a plurality of pressure chambers connected to the respective nozzles;

an actuator unit that is fixed to one surface of the passage unit in order to change the volume of the pressure chambers;

an ink supply unit that is fixed to the passage unit and supplies ink to the passage unit;

a flexible substrate that is connected to the actuator unit and has a signal wire formed thereon for feeding electric power to the actuator unit; and a driver IC that is connected to the flexible substrate in order to drive the actuator unit, wherein the driver IC is held on the ink supply unit.

2. The ink-jet head according to claim 1, wherein the driver IC is held between the ink supply unit and the flexible substrate.

3. The ink-jet head according to claim 2, wherein the flexible substrate has a portion extending in a direction substantially perpendicular to a nozzle face on which a plurality of openings of the nozzles are formed, the driver IC being held between a side face of the ink supply unit and the portion of the flexible substrate.

4. The ink-jet head according to claim 1, wherein at least a part of the ink supply unit closest to the driver IC is made of a metal.

5. The ink-jet head according to claim 1, wherein:

the ink supply unit has a layered structure of a plurality of plates; and among the plurality of plates, a plate closest to the driver IC is thickerthan the other plates.

6. The, ink-jet head according to claim 1, wherein:

the passage unit is fixed to the ink supply unit on a side opposite to the driver IC; and the ink supply unit includes a resin member that is disposed near the passage unit.

7. The ink-jet head according to claim 6, wherein:

the ink supply unit has a layered structure of a plurality of plates including a resin plate; and the driver IC is in contact with, among the plurality of plates, a plate other than the resin plate.

8. The ink-jet head according to claim 1, wherein the ink supply unit includes an ink filter.

9. The ink-jet head according to claim 8, wherein the ink supply unit includes a resin plate having the filter formed therein, and a metal plate bonded to one face of the resin plate.

10. The ink-jet head according to claim 1, wherein a thermal conductive member is interposed between the driver IC and the ink supply unit.

11. The ink-jet head according to claim 1, wherein the ink supply unit has a plate-like protrusion, on which the driver IC is held.

12. The ink-jet head according to claim 11, wherein the driver IC is held between the protrusion and the flexible substrate.

13. The ink-jet head according to claim 11, wherein the protrusion protrudes from each widthwise end of the ink supply unit in a direction perpendicular to a contact surface between the ink supply unit and the passage unit, so that the ink supply unit has a U-shaped section.

14. The ink-jet head according to claim 11, wherein a rib is formed on the protrusion.

15. The ink-jet head according to claim 1, wherein a plurality of the actuator units are fixed to the one surface of the passage unit and the flexible substrate is connected to the each actuator unit, and wherein the neighboring flexible substrates extend in the opposite direction alternately on the surface to which the plurality of the actuator units are fixed.

* * * * *